United States Patent [19]

Higashigawa

[11] 3,939,232

[45] Feb. 17, 1976

[54] CARBURETOR

[75] Inventor: Keizo Higashigawa, Toyota, Japan

[73] Assignee: Toyota Jidosha Kogyo Kabushiki Kaisha, Aichi, Japan

[22] Filed: June 20, 1974

[21] Appl. No.: 481,324

[30] Foreign Application Priority Data

Dec. 10, 1973 Japan ..... 48-136832

[52] U.S. Cl. ..... 261/72 R; 261/DIG. 67

[51] Int. Cl.[2] ..... F02M 5/02

[58] Field of Search ..... 261/DIG. 67, DIG. 2, 72 R

[56] References Cited

UNITED STATES PATENTS

| | | | |
|---|---|---|---|
| 1,683,338 | 9/1928 | Evinrude | 261/72 R |
| 1,872,291 | 8/1932 | Hobbs | 261/72 R |
| 1,912,842 | 6/1933 | Hobbs | 261/72 R |
| 1,916,060 | 6/1933 | Memini | 261/72 R |
| 2,229,851 | 1/1941 | Hufford | 261/72 R |
| 2,701,709 | 2/1955 | Brunner | 261/DIG. 67 |
| 2,851,259 | 9/1958 | Olson | 261/72 R |
| 3,058,728 | 10/1962 | Ruth | 261/DIG. 67 |
| 3,273,871 | 9/1966 | Winkler | 261/DIG. 67 |
| 3,540,423 | 11/1970 | Tolles | 261/DIG. 67 |
| 3,752,135 | 8/1973 | Peterson et al. | 261/72 R |

*Primary Examiner*—Tim R. Miles

*Attorney, Agent, or Firm*—Toren, McGeady and Stanger

[57] ABSTRACT

A float chamber is in communication with the surrounding atmosphere through a valve actuatable in response to a negative pressure in an intake manifold so that when an engine is excessively inclined or upset the valve is closed under the pressure of the fuel in the float chamber. Therefore, the overflow of the fuel into the carburetor barrel may be prevented and a fire in the vehicle avoided.

10 Claims, 5 Drawing Figures

CARBURETOR

BACKGROUND OF THE INVENTION

The present invention relates to a carburetor of the type whose float chamber is in communication through an air vent with the surrounding atmosphere.

In general, the air in the float chamber is communicated through an air vent and an air horn of a carburetor or air cleaner with the surrounding atmosphere so that the fuel supplied into the float chamber through a needle valve may be smoothly discharged into a venturi throat through a fuel discharge nozzle. However, when an automotive vehicle is upset, there is a danger that the fuel in the float chamber flows out through the air vent, thus causing a possible fire in the vehicle.

SUMMARY OF THE INVENTION

In view of the above, the present invention provides a carburetor incorporating a valve which is adapted to be closed under the pressure of the fuel in the float chamber when the engine is excessively inclined or upset, thereby preventing the overflow of the fuel from the float chamber.

DESCRIPTION OF THE PREFERRED EMBODIMENT

Figure 1:
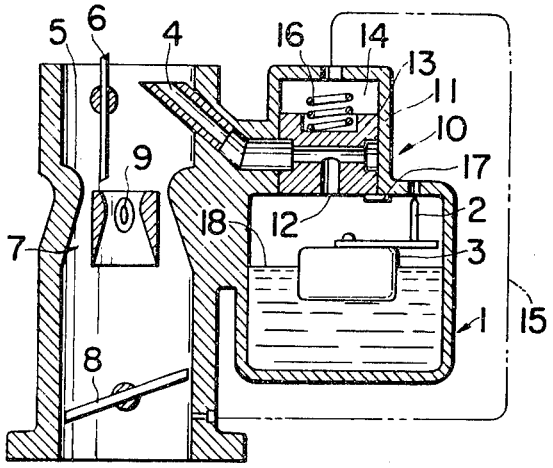
FIG. 1 is a sectional view of a carburetor in accordance with the present invention.

Referring to FIGS. 1–4, the fuel is supplied through a needle valve 2 into a float chamber 1 in such a way that the level of the fuel in the chamber 1 may be kept substantially at the same level by a float 3. The float chamber is in communication through a float chamber vent 4 and a valve 10, to be described in more detail hereinafter, with an air horn 5 of a carburetor including a choke valve 6, a venturi 7, a throttle valve 8, and a discharge nozzle 9 opening into the venturi throat 7 for discharging the fuel.

According to the present invention, the valve 10 is inserted between the float chamber vent 4 and the float chamber 1 so that when the vehicle is upset in the transverse direction, that is when the engine is inclined, the valve 10 is automatically closed by the fuel in the float chamber 1. The valve 10 comprises a cylindrical valve box 11 extending upright from the top of the float chamber 1, a piston-shaped valve 13 slidably fitted into the valve box 11, a passage 12 one end of which is opened at the bottom surface of the valve 13 and the other end of which is opened at the side surface thereof, a negative pressure admission line 15 for admitting the negative pressure in an intake manifold into the upper chamber 14 of the cylinder-shaped valve box 11 above the valve 13, and a coiled spring 16 disposed within the upper chamber 14 so as to normally bias the piston-shaped valve 13 in such a way that the passage 12 may be normally in communication with the float chamber vent 4. Reference numeral 17 denotes a stopper, and 18, the level of fuel in the float chamber 1.

The mode of operation of the carburetor with the above construction will be described hereinafter. When the engine is stopped, there is no negative pressure produced downstream of the throttle valve 8, that is in the intake manifold so that the piston-shaped valve 13 is in the low normal position due to the weight of the piston 13 and the bias at the coiled spring 16. As a result, the passage 12 is in communication with both the float chamber 1 and the float chamber vent 4 as shown in FIG. 1.

Figure 2:
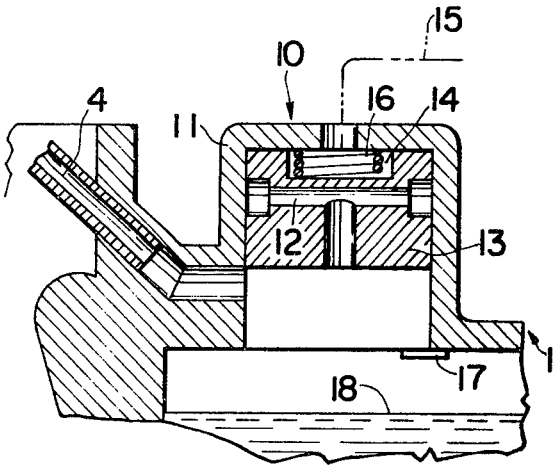
FIGS. 2, 3 and 4 are fragmentary sectional views thereof on an enlarged scale used for the explanation of the mode of operation thereof.

When the engine is operating, negative pressure is produced downstream of the throttle valve 8 and transmitted into the upper chamber 14 of the valve box 11 through the negative pressure transmission line 15 so that the valve 13 is lifted against the coiled spring 16 into the upper position. As a result, the vent 4 is in direct communication with the float chamber 1, as shown in FIG. 2, so that the atmospheric pressure acts upon the level 18 of the fuel in the float chamber 1. Therefore, the fuel is smoothly discharged through the nozzle 9 into the venturi 7 in a manner substantially similar to that of conventional carburetors.

Figure 3:
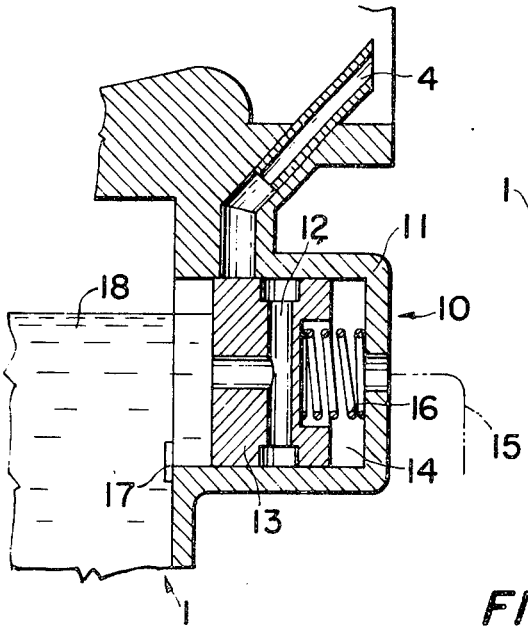

When the vehicle is overturned or upset as shown in FIG. 3, the fuel forces the valve 13 to the right in FIG. 3 and against the spring 16 so that the communication between the passage 12 and float chamber vent 4 is interrupted. Thus, discharge of the fuel into the carburetor is prevented.

Figure 4:
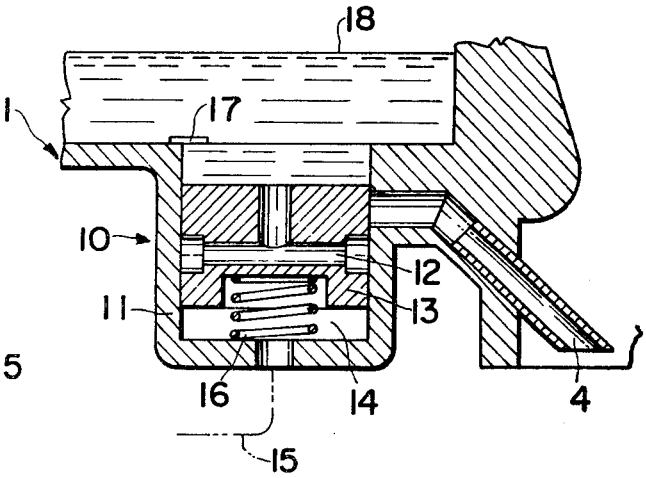

When the vehicle is upset as shown in FIG. 4, the piston-shaped valve 13 is forced downwardly under the pressure of the fuel and the weight of the valve 13 and against the spring 16 so that communication between the passage 12 and the vent 4 may be automatically interrupted. Therefore, the overflow of the fuel into the carburetor may be positively prevented.

Figure 5:
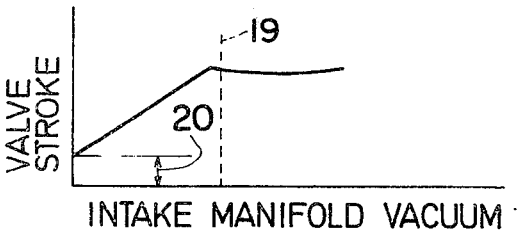
FIG. 5 is a graph illustrating the relationship between the stroke of a piston-shaped valve and the negative pressure in the intake manifold.

FIG. 5 is a graph illustrating the relationship between the stroke of the valve 13 and the negative pressure in the intake manifold. The broken line 19 indicates the negative pressure in the intake manifold when the engine is operated at the minimum speed with the throttle valve wide opened, and the stroke indicated by 20 denotes a play of the valve 13 which is dependent upon the position of the valve 13 shown in FIG. 3.

As described hereinbefore, according to the present invention, the normal function of the carburetor may be ensured when the vehicle is in the normal position, but it the vehicle should be upset, the float chamber vent is automatically closed so that the overflow of the fuel into the carburetor may be positively prevented, thus preventing the fire of the vehicle.

While a specific embodiment of the invention has been shown and described in detail to illustrate the application of the inventive principles, it will be understood that the invention may be embodied otherwise without departing from such principles.

What is claimed is:

1. In a carburetor having an air horn, a choke valve, a venturi, a throttling valve, a discharge nozzle, a float chamber, and an air vent in communication with said float chamber, the improvement comprising valve means located between said float chamber and said air vent for closing said air vent under the pressure of fuel within said chamber when a vehicle is excessively inclined or upset, said valve means comprises a valve box and a piston-shaped valve movable within said valve box, said valve means including an upper chamber formed between said piston-shaped valve and said valve box, and a negative pressure transmission line having one end connected to said upper chamber and the other end connected to the intake manifold of the carburetor.

2. A carburetor comprising a float chamber, an air vent in communication with said float chamber for supplying air to said float chamber so that fuel in the chamber may be smoothly discharged via a nozzle, valve means interposed between said air vent and said float chamber for closing off said air vent when a vehicle containing the carburetor is excessively inclined or upset, said valve means comprises a valve box, a piston-shaped valve slidable within said box for opening or closing said air vent, a passageway formed in said valve, an inner chamber formed between said piston-shaped valve and said valve box on the opposite side of said piston-shaped valve from said float chamber, a negative pressure transmission line having one end connected to said inner chamber and the other end connected to the intake manifold of the carburetor, and spring means located within said inner chamber for biasing said piston-shaped valve toward said float chamber.

3. A carburetor according to claim 2 wherein said passageway has one end opened at the bottom of said piston-shaped valve and the other end opened at a side surface of said piston-shaped valve so that when the engine is shut-off the air vent may be in communication with said float chamber.

4. In a carburetor having an air horn, a choke valve, a venturi, a throttling valve, a discharge nozzle, a float chamber, and an air vent in communication with said float chamber, the improvement comprising valve means located within said float chamber and said air vent for closing said air vent under the pressure of the fuel within said chamber when a vehicle is excessively inclined or upset, said valve means comprises a valve box and a piston-shaped valve movable within said valve box, said piston-shaped valve having a passage formed therein in communication with said air vent, and said passage having one end open at the bottom surface of said piston-shaped valve and its other end open at a side surface of said piston-shaped valve.

5. A carburetor according to claim 4, wherein said valve means further comprises an upper chamber formed between said piston-shaped valve and said valve box, and a negative pressure transmission line having one end connected to said upper chamber and one end connected to the intake manifold of the carburetor.

6. A carburetor according to claim 5, wherein said valve means further comprises spring means mounted within said upper chamber for biasing said piston-shaped valve toward said float chamber.

7. In a carburetor having an air horn, a choke valve, a venturi, a throttling valve, an intake manifold, a discharge nozzle, a float chamber, a float within said float chamber for maintaining the level of fuel therein below the upper end of said float chamber, and an air vent in communication with said valve chamber, wherein the improvement comprises a valve box mounted on and extending upwardly from the upper end of said float chamber and being open to the interior of said float chamber, said valve box having a tubular shaped side wall extending upwardly from the upper end of said float chamber and a top wall extending across the upper end of said side wall spaced from said float chamber, said air vent connected to said side wall, and a piston-shaped valve positioned within said valve box and slidably displaceable along said side walls thereof, said piston having a passage formed therein and said piston being displaceable within said valve box between one position admitting flow through the passage in said piston-shaped valve from said air vent to said flow chamber and another position for blocking flow between said air vent and said float chamber.

8. In a carburetor, as set forth in claim 7, wherein the connection of said air vent to said side wall is spaced from the upper end of said float chamber and from the top wall of said valve box, said piston-shaped valve has a first end surface facing said float chamber and an oppositely disposed second end surface facing the top wall of said valve box, a side surface extending between said first and second end surfaces, and said passage in said piston-shaped valve opening from said first end surface into said float chamber and extending through said piston-shaped valve and opening through the side surface thereof.

9. In a carburetor, as set forth in claim 8, wherein said side wall of said valve box having a height greater than the spacing between the end surfaces of said piston-shaped valve, said top wall of said valve box having an opening therethrough, a negative pressure transmission line having one end connected to the opening in said top wall and the other end thereof connected to said intake manifold, and a spring positioned within said valve box between the second end surface of said piston-shaped valve and said top wall of said valve box for biasing said piston-shaped valve away from said top wall.

10. In a carburetor, as set forth in claim 9, wherein a stopper is located at the junction of said valve box and said float chamber for preventing said piston-shaped valve from being displaced from said valve box into said float chamber.

* * * * *